United States Patent [19]

Ridgway

[11] 4,162,038

[45] Jul. 24, 1979

[54] ROTARY SPRINKLER IMPACT ARM SPRING ADJUSTMENT

[75] Inventor: H. C. Ridgway, Dallas, Tex.

[73] Assignee: Telsco Industries, Inc., Dallas, Tex.

[21] Appl. No.: 888,159

[22] Filed: Mar. 20, 1978

Related U.S. Application Data

[62] Division of Ser. No. 759,727, Jan. 17, 1977, Pat. No. 4,103,828.

[51] Int. Cl.[2] ..... B05B 3/14

[52] U.S. Cl. ..... 239/206; 239/230

[58] Field of Search ..... 239/206, 230, DIG. 1

[56] References Cited

U.S. PATENT DOCUMENTS

| | | | |
|---|---|---|---|
| 2,223,441 | 12/1940 | Coles et al. | 239/230 |
| 3,009,650 | 11/1961 | Alvarez | 239/230 |
| 3,043,522 | 7/1962 | Ryerson | 239/230 |
| 3,088,677 | 5/1963 | Coffey et al. | 239/230 X |
| 3,350,015 | 10/1967 | Friedmann et al. | 239/230 |
| 3,552,410 | 1/1971 | Amtsberg | 267/177 X |

FOREIGN PATENT DOCUMENTS

| | | | |
|---|---|---|---|
| 132933 | 11/1947 | Australia | 239/230 |
| 353206 | 5/1961 | Switzerland | 239/230 |

*Primary Examiner*—Robert W. Saifer

*Attorney, Agent, or Firm*—Richards, Harris & Medlock

[57] ABSTRACT

A rotary sprinkler is provided with structure for adjusting the force applied to the impact arm by the impact arm spring. The sprinkler has a laterally directed nozzle cooperating with the arm to rotate the nozzle and an impact arm journaled on a shaft extending above the nozzle. The arm is mounted within a cage extending above the nozzle. The cage includes a pair of arms extending from the nozzle on opposite sides of the shaft and terminating at their upper ends remote from the nozzle in a top plate. A helical spring surrounds the shaft and is secured at its lower end to the arm. A bushing assembly is mounted in the top plate of the cage and receives the top end of the spring. The bushing assembly may be manually adjusted relative to the top plate to vary the force applied by the spring to the impact arm. The sprinkler is mounted in a bucket-like housing positionable within the ground such that the mouth of the housing is flush with the ground surface. The sprinkler responds to the passage of water through the nozzle by rising from a lower first position retracted in the housing to a raised second position out of the housing. A top cover sized to mate with the mouth of the housing is attached to the top plate of the cage such that when the sprinkler is in the first position the top cover mates with the mouth of the housing to enclose the sprinkler therein.

12 Claims, 8 Drawing Figures

ROTARY SPRINKLER IMPACT ARM SPRING ADJUSTMENT

This is a division of application Ser. No. 759,727, filed Jan. 17, 1977, now U.S. Pat. No. 4,103,828.

BACKGROUND OF THE INVENTION

1. Field of The Invention

The present invention relates to a rotary pulsating sprinkler and more particularly to a system for accurately adjusting the force applied to the impact arm by the impact arm spring.

2. Prior Art

Rotary sprinklers in common use today incorporate a rotatable body carrying a laterally directed nozzle for distributing water or other fluids to a desired area. The main body and nozzle are rotated by an impact arm also rotatable with the body which is actuated by the reaction of a stream of water upon the arm. The impact arm is designed with a deflector at its end which intercepts a stream of water from either a primary or secondary nozzle causing the arm to be deflected against a spring which returns the arm for rotational impact with the body thereby rotating the body in successive increments.

Where the impact arm is overdeflected by the stream of water, the sprinkler may not rotate properly or may operate in a direction reverse from the intended direction. Moreover, where the spring prevents sufficient deflection of the impact arm, the rotary sprinkler will fail to operate properly. The biasing force applied by the spring to the arm can also control the speed at which the rotary sprinkler rotates in its operation. Thus, it has become advantageous to provide the capability for adjusting the biasing force applied by the spring to the impact arm.

Normally, a helical spring surrounding the shaft on which the impact arm is journaled controls the biasing force on which the impact arm is journaled controls the biasing force on the arm. Adjustment to the spring is made by coiling and uncoiling the spring to vary the load transmitted to the arm. In some prior art system, the helical spring is coiled by simply shortening the spring. This is accomplished by drawing one end through its point of attachment to the arm and removing the excess wire after the adjustment. Naturally, such an adjustment becomes irreversible by the mere fact that the excess spring is removed from the spring coil. Moreover, the adjustment can only be made with the sprinkler in the off position.

Other prior art systems have included the attachment of one end of the spring to a cap which is journaled on the shaft about which the impact arm rotates. The cap mates with the shaft through indentions which permit the rotation of the cap relative to the shaft thereby permitting the coiling or uncoiling of the impact arm spring and the resulting adjustment. These systems fail to permit accurate adjustments and, because of the necessity of deforming the mating indention structure in order to adjust the system, result in failure of the system due to the wear resulting from successive adjustments.

To overcome the limitations found in these systems, more positive means for locking the cap member to the shaft of the sprinkler after adjustment have been introduced and include the direct attachment of the cap to the shaft by means of a cotter key which is positioned through apertures in the shaft and corresponding notches in the cap. These systems substantially increase the difficulty and limit the accuracy of the adjustment. Moreover, the adjustment of these systems is difficult if not impossible during the operation of the sprinkler.

The sprinkler head adjustment disclosed in U.S. Pat. No. 3,009,650, Alvarez, discloses still another method of controlling the force applied by the impact arm spring on an impulse sprinkler. This system requires both the disengagement of the head screw and the subsequent rotation of a mounting member therebelow to which the impulse arm spring is attached. Therefore, in this arrangement the adjustment of the impact arm sprinkler cannot be accomplished from above the sprinkler head which is of critical importance where the sprinkler and adjustment structure is obscured by a top cover supported from the sprinkler structure.

Therefore, a need has arisen for a system which provides quick and accurate adjustment of the impact arm spring in a rotary sprinkler while permitting adjustment of the spring during the operation of the sprinkler.

SUMMARY OF THE INVENTION

The present invention provides a system for overcoming many of the limitations heretofore found in prior art rotary sprinkler systems. The present invention provides a system for making extremely fine adjustments of the impact arm spring, quickly and easily, during the operation of the sprinkler.

The present invention includes structure for adjusting the impact arm spring of a rotary sprinkler. The sprinkler has a laterally directed nozzle cooperating with the arm to rotate the nozzle and an impact arm journaled on a shaft extending above the nozzle. The arm is also mounted within a cage extending above the nozzle. In one embodiment of the invention, the cage includes a pair of arms extending from the nozzle on opposite sides of the shaft and terminating at their upper ends remote from the nozzle in a top plate. A helical spring surrounds the shaft and is secured at its lower end to the arm. A bushing is secured at the top end of the spring and is seated in the top plate of the cage. The bushing may be manually adjusted relative to the plate to vary the force applied by the spring to the impact arm.

The present invention further envisions the application of a rotary sprinkler embodying the present invention in a bucket-like housing positionable within the ground such that the mouth of the housing is flush with the ground surface. The sprinkler is mounted in the housing wherein the sprinkler responds to the passage of water through the nozzle by rising from a lower first position retracted in the housing to a raised second position out of the housing. A top cover sized to mate with the mouth of the housing is attached to the top plate of the cage such that when the sprinkler is in the first position the top cover mates with the mouth of the housing to enclose the sprinkler therein. In this embodiment, the top cover is supported above and protects the sprinkler.

In accordance with a more specific embodiment of the invention, the top plate of the cage structure has an aperture therein for receiving the bushing. A shoulder extends from the top plate and receives the top cover thereon. The bushing is seated in the top plate of the cage such that the bushing protrudes out of the aperture in the top plate. In one embodiment of the invention the bushing is slotted in the head such that it may be adjusted by engaging and turning the bushing from the top of the sprinkler. A retainer plate is attachable to the top plate and frictionally contacts the bushing to maintain the bushing in a selected position relative to the top plate. Thus, by merely turning the bushing in its seat, the spring to which it is attached may be coiled or uncoiled to vary the force applied to the impact arm of the rotary sprinkler.

In accordance with another aspect of the invention, the retainer plate overlaps the top cover to retain the cover on the shoulder of the top plate. A friction member or seal is positioned in an annular groove around the bushing and between the bushing and the aperture of the top plate. The seal forms a frictional fit between the bushing and the top plate of sufficient tightness to initially retain the spring adjustment set by turning the bushing. Thus, the bushing may be set at a selected position and is retained in that position by the seal member until the retainer plate may be fitted onto the top plate to more positively restrain the bushing from movement.

In accordance with another embodiment of the invention, the top plate of the cage includes an internal ring gear formed therein and a concentric circular seat formed immediately above the internal gear. The bushing includes a toothed epicyclic gear for mating with teeth of the internal gear in the top plate. The epicyclic gear has fewer teeth formed around the circumference thereof than teeth in the internal gear. The epicyclic gear has a concentric aperture formed therein and receives the upper end of the helical spring in its outer wall. An adjustment fitting having a head for seating in the concentric circular seat of the top plate has an eccentric bushing extending therefrom to engage the concentric aperture in the epicyclic gear. Thus, by turning the adjustment fitting, the teeth of the epicyclic gear are engaged with the internal gear to turn the internal gear at a much slower rate than the adjustment fitting, thereby permitting accurate adjustment of the helical spring.

In still another embodiment of the invention, the bushing includes a spline gear fitted in the top plate of the cage and supporting the upper end of the shaft in which the impact arm rotates. An annular gear for mating with this spline gear is provided and receives the upper end of the helical spring. The annular gear is urged into engagement with the spline gear by the helical spring. In this embodiment, adjustment of the spring is by turning the spline gear or by disengaging the annular gear from the spline gear and rotating it to a desired position. In either of these adjustments, the spline gear is secured to the top plate of the cage to complete the adjustment.

In accordance with still another embodiment of the invention, the bushing includes a ring member having a castelated flange therearound for mating with the top plate of the cage. The helical spring is attached to the ring member and urges the castelated flange into engagement with ribs formed in the top plate. In this embodiment, adjustment is made by disengaging the castelated flange from the ribs in the top plate, turning the ring member to either coil or uncoil the helical spring and then reengaging the flange of the ring member against the ribs of the top plate to lock the setting.

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
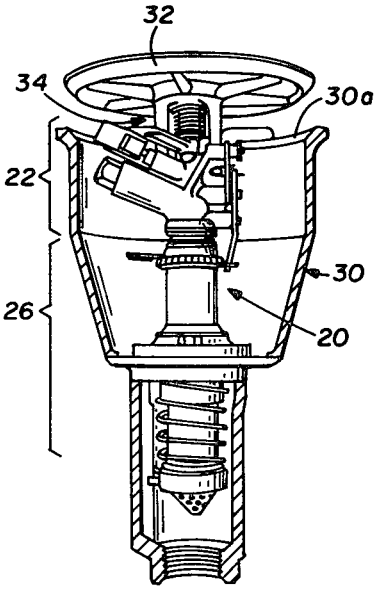
FIG. 1 illustrates a partially broken away perspective view of a rotary pop-up sprinkler embodying the present invention.

FIG. 1 illustrates a partially broken away perspective view of a rotary impulse sprinkler 20 embodying the present invention. Sprinkler 20 includes a nozzle housing 22 supported on an extension tube section 26. The sprinkler 20 illustrated in FIG. 1 is of the "pop-up" type wherein the sprinkler is normally positioned within a bucket like housing 30 when not in operation but automatically is elevated out of housing 20 by the passage of water through extension tube 26 and nozzle housing 22 when the sprinkler 20 is operating. A cover 32 is supported from nozzle housing 22 by a cage structure 34. Normally, housing 30 is positioned within the ground with its upper opening 30*a* level with the ground surface. Thus, when sprinkler 20 is in the off position, and retracted within housing 30, cover 32 mates with opening 30*a* of housing 30 to seal sprinkler 20 within the housing. This provides protection to the sprinkler and completes the ground surface by providing cover 32 level with the ground.

Figure 2:
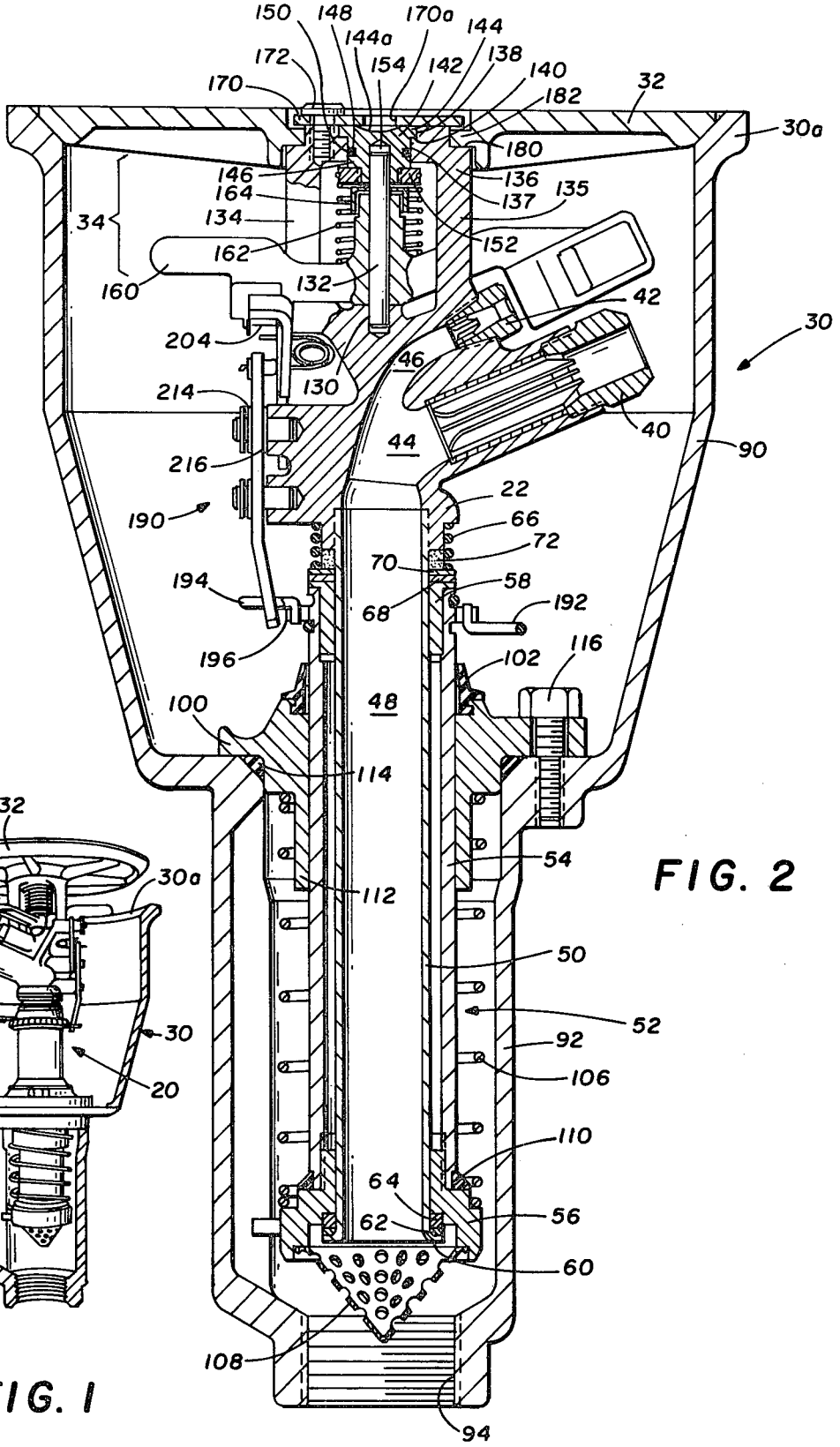
FIG. 2 is a vertical section view of the sprinkler illustrated in FIG. 1.

One embodiment of the system for adjusting the impact arm biasing spring is illustrated by the vertical section of FIG. 2. Nozzle housing 22 includes a range nozzle 40 and a drive nozzle 42 positioned thereabove. Both nozzles communicate by way of internal bores 44 and 46 with bore 48 of flow tube 50 which is threadedly engaged at its upper end within nozzle housing 22. The flow tube 50 is mounted within a guide tube assembly 52 including a guide tube 54 threadedly attached at its lower end to a lower bearing assembly 56 and fitted at its upper end with an upper bearing assembly 58. Flow tube 50 has an outwardly extending radial flange 60 on which thrust washer 62 and lower thrust bearing 64 rest. A preload compression spring 66 acts between nozzle housing 22 and upper bearing 58 assembly of guide tube assembly 52 to apply a compression load on thrust washer 62 and thrust bearing 64 between flange 60 of flow tube 50 and lower bearing 56 of guide tube assembly 52. Preload thrust washer 68 and preload spring washer 70 are positioned between nozzle housing 22 and upper bearing 58. An upper tube seal 72 is likewise positioned between nozzle housing 22 and preload spring washer 70.

Housing 30 includes an upper chamber 90 having an aperture in the lower end thereof communicating to lower chamber 92. Lower chamber 92 has a threaded coupling 94 at the bottom end thereof for accepting a conduit for furnishing water or other fluid to the sprinkler system. The lower end of upper chamber 90 has a landing for receiving guide collar 100 in which guide tube assembly 54 slides.

An annular guide tube wiper ring 102 having an inner diameter aperture closely approximating the outer diameter of guide tube 54 is fitted to guide collar 100 and closely receives guide tube 54 to clean the guide tube as it translates past wiper ring 102. A retraction compression spring 106 encircles guide tube 54 and is compressed between guide collar 100 and a flange landing on lower bearing 56. A strainer 108 is fitted in the lower opening of lower bearing 56 adjacent the opening to flow tube 50.

An annular guide seal 110 is positioned around an upper landing formed on lower bearing 56 and is shaped to mate with a complementary surface 112 at the lower end of guide collar 100. A housing guide seal 114 is fitted between guide collar 100 and housing 30 and is compressed to form a fluid tight seal therebetween when guide collar 100 is fastened to housing 30 by bolts 116.

Nozzle housing 22 has a bore 130 in the head area thereof which receives the lower end of arm pin 132. Cage structure 34 includes arms 134 and 135 extending upwardly from nozzle housing 22 and terminating at their upper ends in a top plate 136. Top plate 136 includes a bore 137 in the head thereof and a larger concentric bore 138 extending partially therethrough to form landing 140 in top plate 136. A spring adjust bushing 142 fits within bore 137 through the top plate and has a slotted head 144 which seats on shoulder 140 and a lower shaft 146 for extending through bore 137.

Shaft 146 has an annular groove 148 therearound and receives an O-ring 150 which partially extends outside of the outer diameter of shaft 146. The lower end of shaft 146 is threaded to receive a spring support ring 152. Shaft 146 further has an internal bore 154 for receiving the upper end of arm pin 132. Impact arm 160 is journaled on arm pin 132 and receives the lower end of impact arm spring 162. The upper end of spring 162 is attached to spring adjust bearing 142 by way of spring support ring 152. An arm cap 164 is positioned between spring support ring 152 and impact arm 160 and is likewise journaled on arm pin 132. Therefore, impact arm 160 is free to rotate about arm pin 132 which in turn is supported at the lower end in bore 130 of nozzle housing 22 and at the upper end of bore 154 of spring adjust bushing 142 supported in top plate 136. Head 144 of spring support bushing 142 is slightly thicker in dimension than the depth of bore 138 and therefore extends slightly above the upper surface of top plate 136 when positioned in bore 137 and supported on landing 140. In one embodiment of the invention, head 144 extends twenty-thousandths of an inch above the upper surface of top plate 136. A retainer plate 170 is attachable to top plate 136 of cage assembly 34 by retainer bolts 172 which are threadedly engaged into top plate 136 and clamp retainer plate 170 against top plate 136. Because of the protrusion of head 144 of bushing 142 above the upper surface of top plate 136, the engagement of retainer plate 170 against top plate 136 locks bushing 142 by compressing the bushing between retainer plate 170 and shoulder 140 of top plate 136. In this way, bushing 142 is maintained in any selected position relative to top plate 136 of cage 34.

Top plate 136 is further provided with an outer annular landing 180 for receiving annular web 182 of cover 32. As can be seen in FIG. 2, web 182 is sized such that retainer plate 170 does not engage the upper surface thereof but overlaps the web to retain cover 32 on top plate 136 without fixedly securing it to the top plate. Cage 34 and top plate 136 are positioned relative to the other structure of sprinkler 20 such that when sprinkler 20 is in the off or retracted position, cover 32 mates with the upper opening of housing 30 to cover the opening thereby protecting sprinkler 20.

A reversing mechanism 190 is attached to nozzle housing 22 and cooperates with locking collars 192 and 194 to control the arc through which the sprinkler moves. Locking collars 192 and 194 are adjustable relative to a detent ring 196 which encircles guide tube 54 thereby providing for varying the arc through which the sprinkler rotates.

In operation of the system illustrated in FIGS. 1 and 2, a water or other fluid source is connected to coupling 94 of housing 30. As water is introduced through coupling 94 into lower chamber housing 92, it is communicated through flow tube 50 and nozzles 40 and 42. The force of the water through the flow tube and out of the restricted nozzle area imparts a vertical force on sprinkler 20 sufficient to compress retract spring 106 thereby lifting the nozzles out of upper chamber housing 90. Cage structure 34 and cover 32 rise in conjunction with the vertical movement of sprinkler 20 such that the sprinkler operates out of housing 90 and above the ground surface in which the housing is normally positioned.

Adjustment of the force exerted by arm spring 162 on arm 160 is periodically required in response to differing water pressures or to vary the speed at which the sprinkler rotates. This is accomplished in the present invention by removal of bolts 172 to remove retainer plate 170 normally covering bushing 142. With retainer plate 170 removed, bushing 142 may be turned to coil or uncoil spring 162 to increase or decrease the force applied by the spring to arm 160. In one embodiment of the invention, bushing 142 is adapted with a slot 144*a* in head 144 to facilitate the adjustment of bushing 142. In still another embodiment of the invention, retainer plate 170 has an aperture 170*a* immediately above bushing 142 through which a tool, such as a screwdriver, may be inserted for turning bushing 142 without the complete removal of cover plate 170.

O-ring 150 sufficiently engages the wall of bore 137 and is sufficient to retain bushing 142 in the adjusted position until retainer plate 170 is engaged against the head of bushing 142 to lock it rigidly in place. Thus, it can be seen that the adjustment of spring 162 may be readily made while the sprinkler is in operation by merely loosening retainer plate 170, engaging bushing 142 and adjusting it as desired.

Also, the present adjustment is unrestricted as in prior art units which require the adjustment structure to be in a particular indentation. Rather, in the present invention the adjustment may be positioned at any point around the full 360 degree travel of bushing 142. In the present invention, it has been found that the present arrangement permits the adjustment of the impact arm spring to precise torque loading. Thus, not only is the adjustment simple, but extremely accurate.

Figure 3:
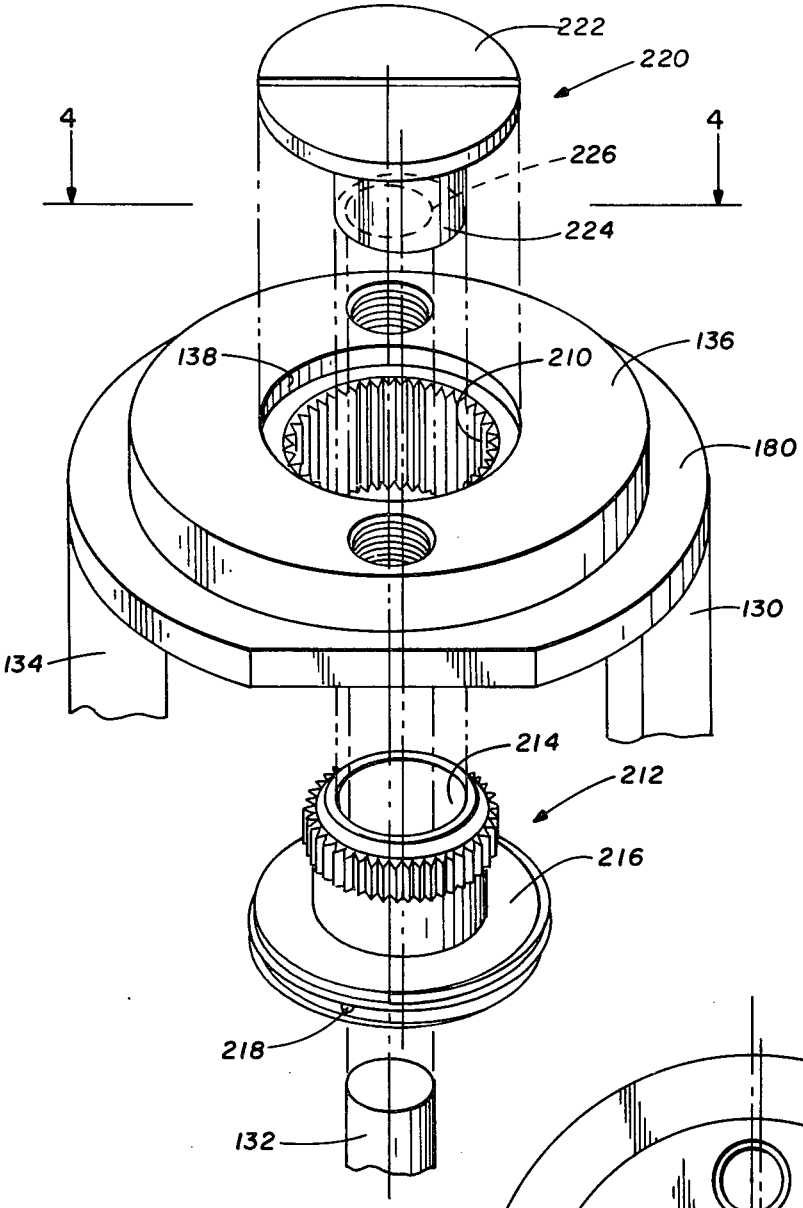
FIG. 3 is a perspective exploded view of an alternative embodiment of the system for adjusting the bias force of the impact arm spring.

FIG. 3 illustrates an alternative embodiment for varying the load exerted by the impact arm spring on the impact arm. In this embodiment, an internal gear 210 is formed in bore 137 through top plate 136. An epicyclic or sun gear 212 mates with internal gear 210 but is formed with fewer gear teeth than are formed in internal gear 210. In one embodiment of the invention sun gear 212 has 50 teeth and internal gear 210 is formed with 53.

Sun gear 212 has an aperture 214 formed concentric therewith and a threaded spring support ring 216 attached at one end thereof. Ring 216 has an aperture 218 in the edge thereof for receiving the upper end of spring 162.

An adjustment fitting 220 is formed with a head 222 for engagement in the concentric circular bore 138 in the top plate 136. The adjustment fitting has a circular eccentric bushing 224 extending therefrom for engagement in the concentric aperture 214 of the sun gear. Bushing 224 also has a bore 226 formed longitudinally therein for receiving the upper end of pin 132. Head 222 may be slotted or otherwise formed to receive a tool for adjustment thereof.

Figure 4:
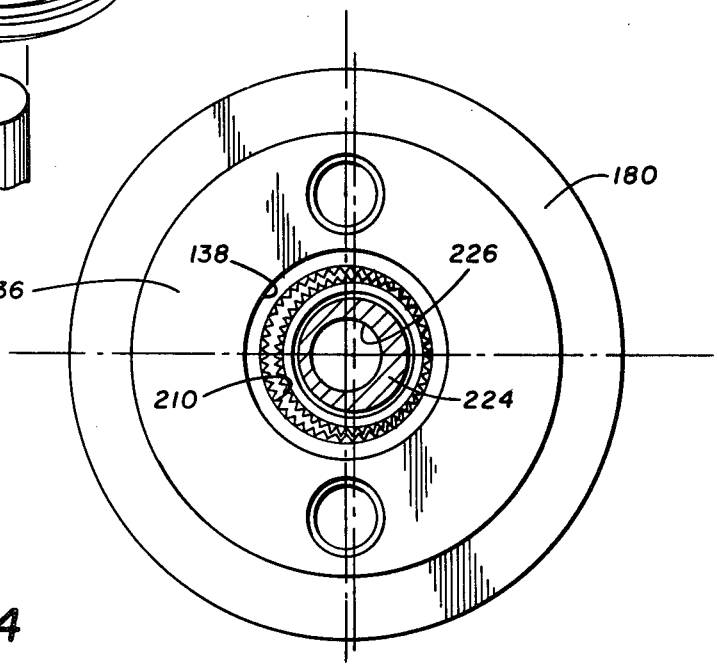
FIG. 4 is a section view taken along line 4—4 of FIG. 3.

The adjustment of the embodiment illustrated in FIGS. 3 and 4 is made by simply turning adjustment fitting 220. As the fitting is turned, the movement of the eccentric bushing 224 forces the teeth of sun gear 212 into engagement with internal gear 210. Because sun gear 212 has fewer teeth than internal gear 210, the meshing of the teeth of the two members around the circumference thereof causes the rotation of sun gear 212 in an opposite direction to that of adjustment fitting 220 and on an order of angular magnitude lower than the adjustment of fitting 220. Therefore, with the embodiment illustrated in FIGS. 3 and 4, the system permits a fine adjustment as the impart arm spring is controlled by the lesser moving sun gear 212.

Figure 5:
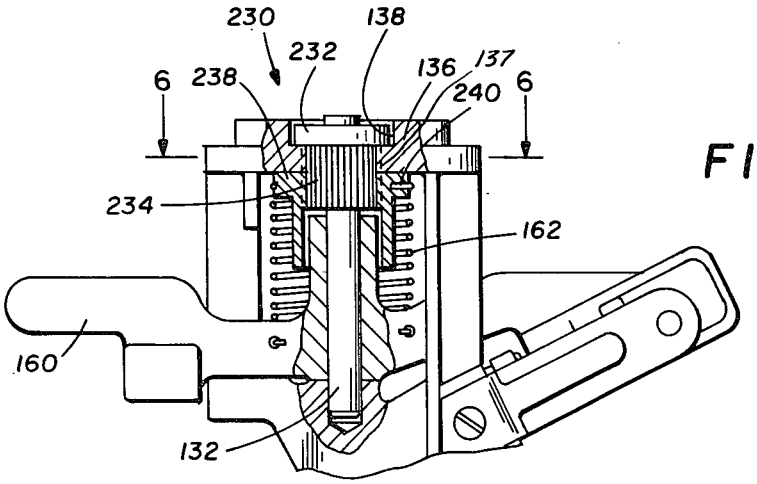
FIG. 5 is a partially broken away side view of an alternative embodiment of the system for adjusting the bias impact arm spring.
Figure 6:
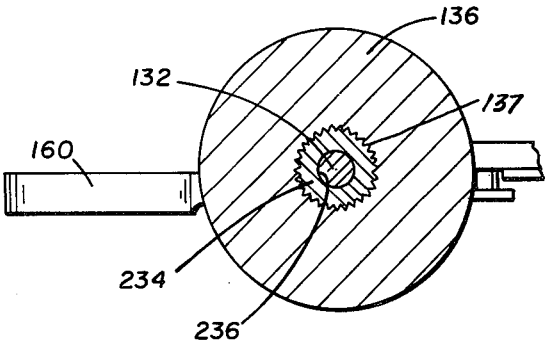
FIG. 6 is a section view taken along line 6—6 of FIG. 5.

Another alternative embodiment for adjusting the coil of the impact arm spring to control the force applied to the impact arm is illustrated in FIGS. 5 and 6. In this embodiment of the invention, a spring adjust bushing 230 is substituted for bushing 142 of the first embodiment illustrated in FIGS. 1 and 2 and includes a head 232 and a spline portion 234 extending downwardly therefrom. Spline portion 234 is formed with a concentric bore 236 therein for receiving the upper end of pin 132. As is shown in FIGS. 5 and 6, bore 137 of top plate 136 is formed with matching splines to receive the spline portion 234 thereby preventing the rotation of bushing 230 relative to top plate 136. Alternatively, head 232 may be sized to create a press fit when inserted in bore 138 in order to fix bushing 230 within top plate 136, or bushing 230 may be staked to top plate 136 by any suitable manner in order to prevent bushing 230 from rotating within the top plate.

A mating bushing 238 is formed with internal splines for mating with the splines of bushing 230 and has an aperture 240 for receiving the upper end of spring 162. In this embodiment, spring 162 is coiled and uncoiled to adjust the load exerted on impact arm 160 by disengaging bushing 238 from engagement with bushing 230 and compressing spring 162, then rotating bushing 238 to any selected position and re-engaging the mating splines between bushings 238 and 230. The spring 162 acts to maintain the engagement by exerting an upwardly force on bushing 238.

Figure 7:
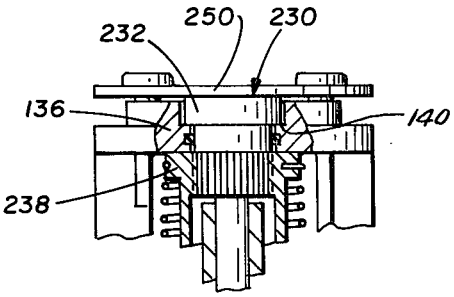
FIG. 7 is a partially broken away side view of another embodiment of the structure for adjusting the impact arm biasing spring.

An alternative arrangement of the embodiment illustrated in FIGS. 5 and 6 is illustrated in FIG. 7. In this embodiment, bushing 230 does not engage top plate 136, but is seated for rotation on shoulder 140. The head 232 is of sufficient thickness as to protrude above the upper surface of top plate 136 thereby permitting the same engagement of the bushing with top plate 136 by the use of a retainer cover 250 similar to that described with respect to the embodiment of FIGS. 1 and 2. In this embodiment, the adjustment may be in one of two ways. Adjustment can be by removing retainer plate 250 and adjusting spring 162 by turning bushing 230 or by retaining bushing 230 in engagement with top plate 136 and by disengaging lower bushing 238 and turning the bushing to coil or uncoil the spring 162 as desired and then re-engaging bushing 238 to bushing 230.

Figure 8:
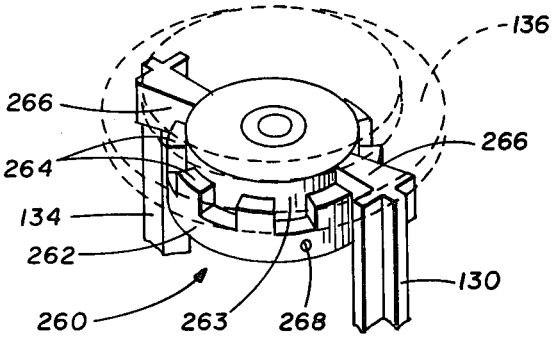
FIG. 8 is a partially broken away perspective view of a another embodiment of the system for adjusting the impact arm biasing spring.

Another embodiment of the present invention for adjusting the load exerted by the impact arm spring on the impact arm is illustrated in FIG. 8. In this embodiment, a spring adjust bushing 260 includes a ring 262 having selected castelations 264 formed thereabout. Ring 262 is engaged for rotation about a circular bushing 263 extending downwardly from top plate 136. Top plate 136 is formed with downwardly protruding ribs 266 which may be engaged by castelations 264. Ring 262 has an aperture 268 formed therein for receiving the upper end of helical spring 162.

In this embodiment of the invention, adjustment of spring 162 is made by disengaging castelations 264 from ribs 266 by compression spring 162. The bushing 260 is then rotated to coil or uncoil spring 162 in order to adjust the load applied by the spring to impact arm 160. When the desired adjustment has been made, bushing 260 and castelations 264 formed thereon are re-engaged against ribs 266 and are retained in the engaged position by the force of compression spring 162.

Thus, the present invention discloses a system for adjusting the force applied by the impact arm spring on the impact arm of a rotary sprinkler. The various embodiments permit ease of adjustment of the spring from above the sprinkler system and in the embodiments illustrated in FIGS. 1, 2, 3 and 4, provide a system permitting infinite adjustment. Moreover, the system provides structure cooperating with the adjustment structure for supporting a protective cover over the sprinkler system while permitting adjustment of the sprinkler without removal of the cover either during operation of the sprinkler or when the sprinkler is not operating.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention.

What is claimed is:

1. Adjustment means for the bias spring on an impact arm of an impact sprinkler having a laterally directed nozzle cooperating with the impact arm comprising:

a shaft extending above the nozzle on which the impact arm is journaled;

a cage extending above the nozzle within which the arm is mounted and having a top plate with a toothed internal ring gear formed in an aperture therethrough and a concentric circular seat formed immediately above the internal ring gear;

a helical biased spring surrounding said shaft and secured at the lower end to the impact arm;

a bushing having a toothed epicyclic gear for mating with the teeth of the internal gear in the top plate, said epicyclic gear having fewer teeth formed around the circumference thereof than teeth in said internal gear, and said epicyclic gear receiving the upper end of said helical spring and having a concentric aperture formed therein; and an adjustment fitting having a head for seating in the concentric circular seat in the top plate of said cage and an eccentric bushing extending therefrom to engage the concentric aperture in said epicyclic gear whereby turning said adjustment fitting engages said epicyclic gear with said internal gear to turn said epicyclic gear thereby adjusting said helical spring.

2. The adjustment means of claim 1 wherein said cage is characterized by:

a pair of arms extending from the nozzle on opposite sides of said shaft, said arms terminating at their ends remote from the nozzle in the top plate of said cage.

3. The adjustment means of claim 1 further comprising:

a top cover; and attachment means for supporting said top cover from the top plate of said cage whereby said top cover is supported above and protects the impact sprinkler.

4. The adjustment means of claim 1 wherein said adjustment fitting is seated in the top plate of said cage such that said fitting protrudes out of the top plate; and further comprising a retainer plate attachable to the top plate to frictionally engage said fitting thereby maintaining said fitting in a selected position relative to the top plate of said cage.

5. The adjustment means of claim 1 wherein said fitting has a slotted head such that said spring may be adjusted by engaging and turning said bushing from the slotted head.

6. An impact sprinkler having a laterally directed nozzle cooperating with an impact arm comprising:

a shaft extending above the nozzle on which the impact arm is journaled;

a cage extending above the nozzle, said cage having a top plate including a toothed internal ring gear formed therein;

a helical spring surrounding said shaft secured at the lower end to the impact arm;

a toothed sun gear for mating with the teeth of the internal gear in the top plate, said sun gear having fewer teeth formed around the circumference thereof than teeth in said internal gear, and said sun gear receiving the upper end of said helical spring; and cam means for engaging the teeth of said sun gear against the teeth of said internal gear such that said sun gear is rotated relative to said internal gear thereby adjusting said helical spring.

7. The impact sprinkler of claim 6 wherein said cage is characterized by:

a pair of arms extending from the nozzle on opposite sides of said shaft, said arms terminating at their ends remote from the nozzle in the top plate of said cage.

8. The impact sprinkler of claim 6 further comprising:

a top cover; and attachment means for supporting said top cover from the top plate of said cage whereby said top cover is supported above and protects the impact sprinkler.

9. The impact sprinkler of claim 6 wherein a concentric circular seat is formed immediately above said internal gear in the top plate of said cage and said sun gear is formed with a concentric aperture therethrough, and wherein said cam means includes an adjustment fitting having a head for seating in the concentric circular seat in said top plate and an eccentric bushing extending therefrom for engagement with the concentric aperture in said sun gear such that turning said adjustment fitting engages said sun gear with said internal gear to turn said sun gear.

10. The impact sprinkler of claim 9 wherein said adjustment fitting is seated in the top plate of said cage such that said fitting protrudes out of the top plate; and further comprising a retainer plate attachable to the top plate to frictionally engage said fitting thereby maintaining said fitting in a selected position relative to the top plate of said cage.

11. The impact sprinkler of claim 9 wherein said fitting has a slotted head such that said spring may be adjusted by engaging and turning said bushing from the slotted head.

12. The impact sprinkler of claim 9 further comprising:

a bucket-like housing having a mouth thereto;

means for mounting the sprinkler in the housing wherein said sprinkler responds to the passage of water therethrough by rising from a lower first position in said housing to a raised second position out of the mouth of said housing;

a top cover for mating with the mouth of said housing and having an aperture therethrough providing access to said adjustment fitting from above said top cover; and means for attaching said top cover to the top plate of said cage whereby said top cover mates with the mouth of said housing to enclose the impact sprinkler in said housing when the impact sprinkler is in the first position.

* * * * *

UNITED STATES PATENT AND TRADEMARK OFFICE

CERTIFICATE OF CORRECTION

PATENT NO. : 4,162,038

DATED : July 24, 1979

INVENTOR(S) : Telsco Industries, Inc.

It is certified that error appears in the above-identified patent and that said Letters Patent are hereby corrected as shown below:

Column 1, lines 40 - 41, delete "on which the impact arm is journaled controls the biasing force"

Column 1, line 43, change "system" to -- systems --

Column 4, line 34, change "housing 20" to -- housing 30 --

Column 5, line 46, change "bearing 142" to -- bushing 142 --

Column 7, line 36, change "impart" to -- impact --

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*